United States Patent [19]

Nishio

[11] 4,427,529

[45] Jan. 24, 1984

[54] DISTILLING SHALE OIL FROM OIL SHALE

[75] Inventor: Hiroaki Nishio, Yokohama, Japan

[73] Assignee: Nippon Kokan Kabushiki Kaisha, Tokyo, Japan

[21] Appl. No.: 360,064

[22] Filed: Mar. 22, 1982

[30] Foreign Application Priority Data

Mar. 27, 1981 [JP] Japan ..... 56-43999

[51] Int. Cl.[3] ..... C10G 51/00; C10B 49/00; C10B 53/00

[52] U.S. Cl. ..... 208/11 R; 201/12

[58] Field of Search ..... 208/11 A; 201/12

[56] References Cited

U.S. PATENT DOCUMENTS

| | | | |
|---|---|---|---|
| 2,441,386 | 5/1948 | Berg | 208/11 R X |
| 3,265,608 | 8/1966 | Crawford | 208/11 R |
| 3,655,518 | 4/1972 | Schmanfeld et al. | 208/11 R X |
| 3,703,052 | 11/1972 | Linden | 208/11 R X |
| 3,841,993 | 10/1974 | Wunderlich et al. | 208/11 R |
| 4,010,092 | 3/1977 | Deering | 208/11 R |
| 4,058,205 | 11/1977 | Reed, Jr. | 208/11 R X |
| 4,158,620 | 6/1979 | Beck | 208/11 R |
| 4,160,719 | 7/1979 | Pollock | 208/11 R |
| 4,342,640 | 8/1982 | Lewis | 208/11 R |

*Primary Examiner*—Delbert E. Gantz
*Assistant Examiner*—Glenn A. Caldovola
*Attorney, Agent, or Firm*—Frishauf, Holtz, Goodman & Woodward

[57] ABSTRACT

A method for distilling shale oil from oil shale, which comprises: supplying an oil shale together with a granular heat medium heated to a prescribed temperature in a heating furnace to a distiling furnace, where a gas containing a gaseous shale oil, hydrogen and carbon monoxide is separated by vaporization from said oil shale through heat exchange with said granular heat medium; separating the liquid shale oil from said gas, separating said granular heat medium from the waste oil shale after separation of said gas; and then, feeding back said granular heat medium into said heating furnace to reheat said heat medium again to said prescribed temperature and to use said heat medium in recycle. In said method, said granular heat medium comprises manganese oxides and iron oxides. The heat of said granular heat medium is replenished with the heat produced by exothermic reaction of said hydrogen and said carbon monoxide contained in said gas with $Mn_2O_3$ contained in said granular heat medium and reducing by means of said hydrogen and said carbon monoxide contained in said gas, $Fe_2O_3$ contained in said granular heat medium into $Fe_3O_4$ and Fe to impart magnetism to said granular heat medium; and, magnetically separating said granular heat medium from said waste oil shale.

14 Claims, 1 Drawing Figure

DISTILLING SHALE OIL FROM OIL SHALE

FIELD OF THE INVENTION

The present invention provides a method for distilling shale oil from oil shale by means of a granular heat medium heated to a prescribed temperature.

BACKGROUND OF THE INVENTION

Along with the recent world-wide tendency toward exhaustion of petroleum resources, general attention is given to shale oil available from oil shale existent underground in large quantities as a new fuel oil. However, since shale oil is contained in oil shale in only such a small amount as for example about 60 kg per ton of oil shale, industrial distillation of shale oil from oil shale requires huge distilling facilities. There is therefore a demand for developing a method for efficiently distilling shale oil from oil shale.

The methods for distilling shale oil from oil shale now in operation on an industrial scale or considered to be in operation on the future in an industrial scale may be broadly classified into the following three types, depending upon the means for supplying the heat for distillation:

(1) with the heat of fuel burning in the distilling furnace;

(2) with the heat of a high-temperature gaseous heat medium blown into the distilling furnace; and, (3) with the heat of a high-temperature granular heat medium supplied into the distilling furnace.

In the method (1), a fuel and the air are blown directly into the distilling furnace fed with an oil shale to cause combustion of the blown fuel, and shale oil is distilled from the oil shale with the combustion heat of the fuel. This method, having the advantage of a high thermal efficiency for distillation, is problematic in that the quality of the resultant shale oil is degraded by the combustion gas of the fuel and the yield of shale oil is rather low.

In the method (2), a high-temperature gas as the heat medium is blown into the distilling furnace fed with an oil shale, and shale oil is distilled from the oil shale by the heat of the blown gas. This method, being advantageous in the availability of a high-quality shale oil and a high yield, is problematic in that distillation requires a large quantity of high-temperature gaseous heat medium, and an enormous amount of fuel and power costs is required for heating the gas to produce this high-temperature gaseous heat medium and for cooling the gas after distillation for use in recycle.

In the method (3), an oil shale is supplied together with a high-temperature granular heat medium, and shale oil is distilled from the oil shale with the heat contained in the granular heat medium. This method is advantageous in that a high-quality shale oil and a high yield are available and the method requires only small distilling facilities as compared with the method (2). The method (3) is however problematic in that distillation requires a large quantity of high-temperature granular heat medium, and it is not easy to separate the granular heat medium from the waste oil shale after distillation treatment.

Now, the TOSCO II process and the LURGI-RUHRGAS process, which are typical processes representing the method (3), are described below. The TOSCO II process employes, for example, ceramic balls having a diameter of 12.7 mm as the granular heat medium. This process comprises heating ceramic balls to a temperature of from 600° to 650° C. in a heating furnace, and supplying the high-temperature ceramic balls thus heated, together with an oil shale previously dried and then preheated to a temperature of 110° C., into a rotary kiln type distilling furnace; bringing, in the distilling furnace, the ceramic balls into contact with the oil shale; separating from the oil shale a gas containing a gaseous shale oil, hydrogen and carbon monoxide; and, introducing the gas thus obtained from the distilling furnace into separator where said gas is cooled to separate a liquid shale oil from said gas.

The TOSCO II process further comprises discharging the waste oil shale after the separation of the gas and the ceramic balls; separating, by means of a screen, the ceramic balls from the waste oil shale; then, feeding back the ceramic balls cooled through heat exchange with said oil shale thus separated into the heating furnace to reheat it to said prescribed temperature; supplying the fed-back ceramic balls to the distilling furnace to use in recycle; and rejecting the waste oil shale after cooling.

In the process mentioned above, however, since the waste oil shale after separation of the gas is separated from the ceramic balls through a screen, it is necessary to previously crush the oil shale to a size smaller than the diameter of the ceramic balls (12.7 mm for example). This requires special crushing facilities and a crushing process. The quantity of required ceramic balls to be used in recycle is from three to four times that of oil shale fed to the distilling furnace. Furthermore, ceramic balls worn out during use and reduced in size to a diameter smaller than the waste oil shale after distillation cannot be separated through a screen and must be rejected together with the waste oil shale, thus leading to an economic disadvantage.

The LURGI-RUHRGAS process employs waste oil shale as the granular heat medium and comprises heating this waste oil shale to a prescribed temperature in a heating furnace, bringing the waste oil shale into contact with an oil shale in a distilling furnace as in the aforementioned process, and separating by vaporization a gas containing gaseous shale oil from the oil shale through heat exchange with said waste oil shale.

In the above-mentioned process, however, carbon remaining in the waste oil shale after separation of the gas is burnt to utilize the heat of the exhaust gas thereof. Since this combustion treatment covers also the waste oil shale as the granular heat medium of which the residual carbon has already been burnt, combustion of the residual carbon in the new waste oil shale cannot be effected sufficiently, thus making it impossible to utilize the heat of exhaust gas produced by combustion of the residual carbon. In order to solve this difficulty, it would be necessary to separate the new waste oil shale after separation of the gas from the waste oil shale serving as the granular heat medium, but this is practically impossible. In addition, this process requires a large quantity of waste oil shale as the granular heat medium.

As described above, the methods comprising supplying an oil shale together with a high-temperature granular heat medium into a distilling furnace, bringing the oil shale into contact with the granular heat medium in the distilling furnace, and distilling a shale oil from the oil shale through heat exchange with the granular heat medium, although having an advantage of the availability of a high-quality shale oil, require a large quantity of granular heat medium, thus resulting in a low treatment efficiency of oil shale. In addition, it is necessary to crush the oil shale to a specific size for the purpose of separating the granular heat medium from the waste oil shale discharged from the distilling furnace, and this separation may become impossible, depending upon the type of the granular heat medium in use.

A conceivable method for reducing the quantity of required granular heat medium used in recycle is to use a temperature higher than the above-mentioned range of from 600° to 650° C. for the granular heat medium supplied to the distilling furnace and thus to supply the high-temperature granular heat medium to the distilling furnace. However, when employing a granular heat medium of such a high temperature, the surfaces of oil shale in contact with this granular heat medium are locally overheated, producing a carbonized film which prevents satisfactory distillation of the oil shale, and this is not desirable because of the resultant decrease in the shale oil yield.

Under such circumstances, there is a strong demand for the development of a method which permits manufacture of a high-quality shale oil at a high efficiency with the use of a small quantity of granular heat medium when supplying an oil shale together with a high-temperature granular heat medium to a distilling furnace, bringing the oil shale into contact with this granular heat medium, and thus distilling a shale oil from the oil shale through heat exchange with said granular heat medium, but such a method has not as yet been proposed.

SUMMARY OF THE INVENTION

An object of the present invention is therefore to provide a method for distilling a shale oil from an oil shale, which permits manufacture of a high-quality shale oil at a high efficiency with the use of a small quantity of granular heat medium when supplying an oil shale together with a high-temperature granular heat medium to a distilling furnace, bringing the oil shale into contact with this granular heat medium, and thus distilling a shale oil from the oil shale through heat exchange with said granular heat medium.

Another object of the present invention is to provide a method for distilling a shale oil from an oil shale, which permits easy separation of the waste oil shale from the granular heat medium as discharged from the distilling furnace, irrespective of the particle size thereof.

In accordance with one of the features of the present invention, there is provided a method for distilling a shale oil from an oil shale, which comprises:

heating a granular heat medium to a prescribed temperature in a heating furnace; supplying an oil shale together with said granular heat medium thus heated to a distilling furnace, where said oil shale is brought into contact with said heated granular medium to separate by vaporization a gas containing a gaseous shale oil, hydrogen and carbon monoxide from said oil shale through heat exchange with said granular heat medium; introducing said gas thus obtained from said distilling furnace into a separator, where said gas is cooled to separate a liquid shale oil from said gas; separating said granular heat medium from the waste oil shale after separation of said gas; and then, feeding back said granular heat medium cooled through said heat exchange with said oil shale into said heating furnace to reheat said heat medium again to said prescribed temperature and to use said heat medium in recycle;

characterized by:

said granular heat medium comprising manganese oxides and iron oxides;

replenishing the heat of said granular heat medium with the heat produced through exothermic reaction of said hydrogen and said carbon monoxide contained in said gas with dimanganese trioxide ($Mn_2O_3$) contained in said granular heat medium;

reducing, by means of said hydrogen and said carbon monoxide contained in said gas, ferric trioxide ($Fe_2O_3$) contained in said granular heat medium into ferroso-ferric oxide ($Fe_3O_4$) and metallic iron (Fe) both having magnetism to impart magnetism to said granular heat medium; and magnetically separating said granular heat medium from said waste oil shale.

DETAILED DESCRIPTION OF THE PREFERRED EMBODIMENTS

Figure 1:
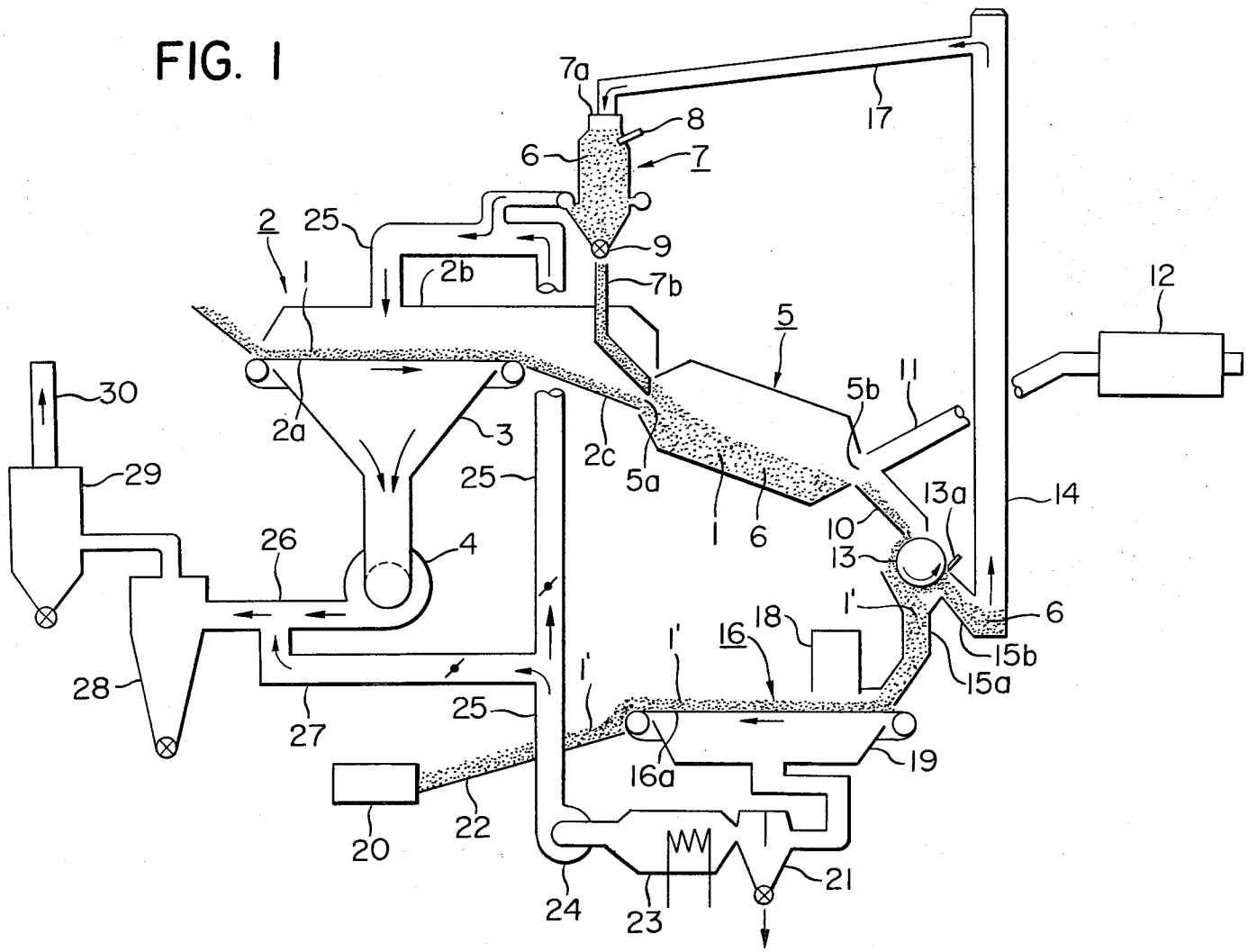
FIG. 1 is a schematic descriptive view illustrating an example of the apparatus for carrying out the method of the present invention.

With a view to solving the many problems involved in the methods for distilling a shale oil from an oil shale as mentioned above, we carried out extensive studies.

In order to efficiently distill shale oil from oil shale, it is necessary to supply heat to the oil shale so as to heat the oil shale rapidly to the temperature range of from 400° C. to 550° C. most suitable for vaporization of the shale oil from the oil shale and keep the oil shale at this temperature. We studied means capable of satisfying the above-mentioned condition with a small quantity of granular heat medium, and as a result, we found that the heat required for vaporization of the shale oil may be supplied, with the use of a granular heat medium which reacts exothermically, and moreover, that, by imparting magnetism to a granular heat medium having the above-mentioned property, separation of the waste oil shale from the granular heat medium as discharged from the distilling furnace can be easily effected magnetically irrespective of the particle size thereof.

The present invention was made on the basis of the above-mentioned findings, and the method for distilling shale oil from oil shale of the present invention comprises:

heating a granular heat medium to a prescribed temperature in a heating furnace; supplying an oil shale together with said granular heat medium thus heated to a distilling furnace, where said oil shale is brought into contact with said heated granular heat medium to separate by vaporization a gas containing a gaseous shale oil, hydrogen and carbon monoxide from said oil shale through heat exchange with said granular heat medium; introducing said gas thus obtained from said distilling furnace into a separator, wherein said gas is cooled to separate a liquid shale oil from said gas; separating said granular heat medium from the waste oil shale after separation of said gas; and then, feeding back said granular heat medium cooled through said heat exchange with said oil shale into said heating furnace to reheat said heat medium again to said prescribed temperature and to use said heat medium in recycle;

characterized by:

said granular heat medium comprising manganese oxides and iron oxides;

replenishing the heat of said granular heat medium with the heat produced through exothermic reaction of said hydrogen and said carbon monoxide contained in said gas with dimanganese trioxide ($Mn_2O_3$) contained in said granular heat medium;

reducing, by means of said hydrogen and said carbon monoxide contained in said gas, ferric trioxide ($Fe_2O_3$) contained in said granular heat medium into ferroso-ferric oxide ($Fe_2O_4$) and metallic iron (Fe) both having magnetism to impart magnetism to said granular heat medium; and magnetically separating said granular heat medium from said waste oil shale.

The granular heat medium, comprising manganese oxides and iron oxides, used in the present invention comprises a manganese ore containing iron oxides, or a pellet comprising manganese oxides and iron oxides. Now, the reasons why a granular heat medium comprising manganese oxides and iron oxides is used in the present invention are described hereinafter.

Vaporization of shale oil from the oil shale is initiated at a temperature of about 320° C., and becomes active in the temperature range of from 400° to 550° C., thus causing separation of a gas containing gaseous shale oil from the oil shale. This gas contains, in addition to said gaseous shale oil, a large quantity of hydrogen and small quantities of carbon monoxide, methane, ethylene and various other constituents.

Manganese oxides contained in the granular heat medium are present in the form of $MnO_2$, $MN_2O_3$, $Mn_3O_4$ and MnO. Among these forms of manganese oxides, $MnO_2$ is decomposed by releasing oxygen and becomes dimanganese trioxide ($Mn_2O_3$) in the temperature range of from 400° to 550° C. In the presence of hydrogen or carbon monoxide, this dimanganese trioxide ($Mn_2O_3$) is reduced at a temperature of about 340° C. through reaction with said hydrogen or carbon monoxide into trimanganese tetroxide ($Mn_3O_4$). This reducing reaction, based on any of the following formulae (1) and (2), produces a considerable heat, and at a temperature of over 500° C., this exothermic reducing reaction proceeds rapidly.

$$3Mn_2O_3+H_2 \rightarrow 3Mn_3O_4+H_2O \ +25{,}350 \text{ Kcal/Kgmol } (H_2) \quad (1)$$

$$3Mn_2O_3+CO \rightarrow 2Mn_3O_4+CO_2 \ +44{,}330 \text{ Kcal/Kgmol } (CO) \quad (2)$$

When reactions for the above-mentioned formulae (1) and (2) take place, the reverse reactions hardly occur. The reducing reaction from $Mn_3O_4$ into MnO does not occur until the temperature exceeds 700° C., and the reducing reaction from MnO into Mn is very difficult to occur.

Since vaporization of shale oil from the oil shale actively proceeds within the temperature range of from 400 to 550° C., as described above, this temperature range agrees with that within which exothermic reducing reactions of $Mn_2O_3$ as expressed by said formulae (1) and (2) actively proceed.

Therefore, by employing a granular heat medium comprising manganese oxides and iron oxides when distilling shale oil from oil shale, the heat contained in the granular heat medium is replenished with heat produced when dimanganese trioxide ($Mn_2O_3$) contained in the granular heat medium reacts with hydrogen and carbon monoxide contained in a gas separated by vaporization from the oil shale, and is thus reduced into trimanganese tetroxide ($Mn_3O_4$). It is therefore possible to distill a shale oil from an oil shale with the use of a granular heat medium in a quantity smaller than that required conventionally.

In the temperature range of from 400° to 550° c. within which vaporization of shale oil from the oil shale proceeds actively, ferric trioxide ($Fe_2O_3$) contained in the granular heat medium is easily reduced into ferroso-ferric oxide ($Fe_3O_4$) in a hydrogen or carbon monoxide atmosphere. Ferroso-ferric oxide ($Fe_3O_4$) is further reduced to metallic iron (Fe) within said temperature range, under a condition of the atmosphere of $H_2O/(H_2+H_2O)<0.1$, or $CO_2/(CO+CO_2)<0.5$ as expressed in mol ratio.

If the oil shale has been previously dried to reduce the water content before the supply of the oil shale to the distilling furnace, the gas separated by vaporization from the oil shale during distillation sufficiently satisfy the above-mentioned condition, and thus, ferric trioxide ($Fe_2O_3$) contained in the granular heat medium is reduced to metallic iron (Fe).

Ferroso-ferric oxide ($Fe_3O_4$) and metallic iron (Fe), both being ferromagnetic, have a magnetic transformation point of 593° C. and 760° C., respectively, and all these temperatures are higher than the vaporization temperature range of shale oil of from 400° C. to 550° C.

Therefore, by conducting distillation with the use of a granular heat medium comprising manganese oxides and iron oxides, $Fe_2O_3$ contained in the granular heat medium is reduced by hydrogen and carbon monoxide contained in the gas separated by vaporization from the oil shale into $Fe_3O_4$ and Fe, and magnetism is imparted to the granular heat medium itself. Therefore, the waste oil shale and the granular heat medium discharged from the distilling furnace can be magnetically separated with the use of magnetism of the granular heat medium.

Each of a natural manganese ore containing iron oxides, and a manganese pellet containing iron oxides is very suitable as the above-mentioned granular heat medium, the latter is manufactured by forming the powdered fraction of this manganese ore, powdery manganese oxides and iron oxides into a formed mixture thereof and firing the resultant formed mixture. More particularly, the former, i.e., the natural manganese ore containing iron oxides is very easily available, and the latter, i.e., manganese pellet containing iron oxides permits easy control of the iron oxide content by forming it from a combination of several raw materials.

Table 1 shows an example of the chemical composition of the granular heat medium used in the present invention. Manganese ore A, produced in South Africa, contains 51.88 wt.% Mn in total and 11.83 wt.% Fe in total. Manganese ore B, produced in Brazil, contains 48.86 wt.% Mn in total and 4.72 wt.% Fe in total. Manganese pellet, manufactured by forming and firing fine manganese ore produced in Brazil, contains 59.21 wt.% Mn in total and 3.10 wt.% Fe in total.

TABLE 1

| | (wt. %) | | | | | | | | |
|---|---|---|---|---|---|---|---|---|---|
| | T.Mn | MnO | $MnO_2$ | T.Fe | $SiO_2$ | $Al_2O_3$ | CaO | MgO | C.W. |
| Manganese ore A | 51.88 | 35.41 | 38.70 | 11.83 | 4.55 | 0.54 | 1.73 | 1.06 | 1.16 |
| Manganese ore B | 48.86 | 2.43 | 74.35 | 4.72 | 2.82 | 4.56 | 0.38 | 0.37 | 4.52 |
| Manganese pellet | 59.21 | 54.10 | 27.39 | 3.10 | 4.06 | 5.98 | 0.14 | 0.12 | tr. |

The manganese ores and the manganese pellet shown in Table 1 contain the Mn constituent in an amount sufficient to cause exothermic reaction of hydrogen and carbon monoxide contained in the gas separated by vaporization from oil shale, and contain the Fe constituent in an amount sufficient to cause a reducing reaction of $Fe_2O_3$ by means of said hydrogen and carbon monoxide.

The content of such iron oxides in the granular heat medium should preferably be within the range of from 3 to 12 wt.%. More specifically, with an iron oxide content of under 3 wt.%, magnetism imparted to the granular heat medium is too weak, resulting in insufficient magnetic separation of the granular heat medium from the waste oil shale. On the other hand, the reactions taking place when $Fe_2O_3$ contained in the granular heat medium is reduced into $Fe_3O_4$ and Fe are both endothermic reactions based on the following formulae (3) and (4).

$$3Fe_2O_3+H_2\rightarrow 2Fe_3O_4+H_2O \quad -6{,}480\ \text{Kcal/Kgmol}\ (H_2) \tag{3}$$

$$\tfrac{1}{4}Fe_3O_4+H_2\rightarrow \tfrac{3}{4}Fe+H_2O \quad -19{,}340\ \text{Kcal/Kgmol}\ (H_2) \tag{4}$$

Therefore, with an iron oxide content of over 12 wt.% in the granular heat medium, the endothermic reactions represented by the above-mentioned formulae (3) and (4) in the distilling furnace become active, and prevent replenishment of heat of the granular heat medium with the exothermic reducing reaction of $Mn_2O_3$ into $Mn_3O_4$ represented by the aforementioned formulae (1) and (2). For such considerations, the iron oxide content in the granular heat medium should preferably be up to 12 wt.%.

It is desirable to preheat the oil shale prior to the supply to the distilling furnace. This permits reduction of the necessary amount of the granular heat medium used in recycle of the granular heat medium, thus leading to a higher thermal efficiency. The highest possible preheating temperature under the initiation temperature of the vaporization (normally about 320° C.) of shale oil from the oil shale is effective. However, since it is difficult to uniformly preheat the oil shale as a whole, if the preheating temperature is brought close to the above-mentioned initiation temperature of the vaporization of the shale oil, the temperature of the oil shale locally exceeds said initiation temperature of the vaporization, and thus the vaporization of shale oil from the oil shale is initiated. Therefore, a preheating temperature of oil shale of about 250° C. is preferable.

Now, the case in which the manganese pellets shown in the above-mentioned Table 1 are employed as the granular heat medium in accordance with the method of the present invention, and the case in which the conventional ceramic balls are employed as the granular heat medium are explained below as to the respective amounts of the granular heat medium used in recycle, by means of examples. The following Table 2 shows an example of the chemical composition of oil shale.

TABLE 2

| (wt. %) | | | | |
|---|---|---|---|---|
| C | H | N | S | Ash |
| 12.8 | 11.0 | 0.4 | 0.8 | 73.0 |

The oil shale having the above-mentioned chemical composition was preheated to a temperature of 250° C., and the manganese pellets as the granular heat medium were heated to a temperature of 650° C. A mixer was employed as the distilling furnace, and the oil shale and the manganese pellets were supplied to the mixer and mixed sufficiently. From the oil shale preheated to 250° C., a gas containing gaseous shale oil, hydrogen and carbon monoxide was separated by vaporization through heat exchange with the manganese pellets heated to 650° C. Heat of the manganese pellets was replenished with the exothermic reaction of hydrogen and carbon monoxide contained in this gas with $Mn_2O_3$ contained in the manganese pellets, and vaporization of the shale oil and from the oil shale proceeded rapidly. As a result, the quantity of supplied manganese pellets was only 1.4 times the quantity of supplied oil shale. When distillation was carried out under the same conditions as above with the use of the conventional ceramic balls as the granular heat medium, the quantity of supplied ceramic balls was 2.4 times that of oil shale.

Now, an embodiment of the apparatus for carrying out the method of the present invention is described with reference to the schematic descriptive view of FIG. 1. In FIG. 1, 2 is a preheater of the travelling grate type for preheating oil shale 1; 3 is a wind box; and, 4 is a blower. The oil shale 1 is supplied to the inlet of the travelling grate 2*a* of the preheater 2, and dried by a hot blast which is blown from a hood 2*b* and sucked through the wind box 3 by the blower 4, while the oil shale 1 is transferred in the arrow direction on the travelling grate 2*a*, and at the same time preheated to a temperature of about 250° C.

In FIG. 1, 5 is a rotary kiln serving as the distilling furnace. The oil shale 1 preheated in the preheater 2 is supplied to the rotary kiln 5 through the inlet 5*a* thereof from a chute 2*c* provided in contact with the outlet of the travelling grate 2*a*. Also in FIG. 1, 7 is a heating furnace for oxidizing and heating manganese pellets 6 having for example the chemical composition shown in Table 1 as the granular heat medium. The heating furnace 7 is provided with a burner at the top thereof, and also provided with a chute 7*b* at the bottom thereof running to the inlet 5*a* of the rotary kiln 5 through a rotary valve 9. The manganese pellets 6 are heated in the heating furnace 7 to a temperature of about 650° C., then discharged from the rotary valve 9 by a prescribed quantity, and supplied via the chute 7*b* to the rotary kiln 5 through the inlet 5*a* thereof.

The oil shale 1 at about 250° C. supplied from the chute 2c into the rotary kiln 5 is brought into contact with the manganese pellets 6 of about 650° C. supplied from the chute 7b also into the rotary kiln 5, and the oil shale 1 is heated with the heat of the manganese pellets 6. Vaporization of the shale oil from the oil shale 1 thus heated is initiated at a temperature of the oil shale of about 320° C., and causes separation by vaporization of a gas containing a gaseous shale oil, hydrogen, carbon monoxide, methane, ethylene, etc. This gas comes into contact with the manganese pellets 6, and reduces $Mn_2O_3$ contained in the manganese pellets 6 into $Mn_3O_4$ by means of hydrogen and carbon monoxide contained in the gas. The heat produced during this exothermic reducing reaction brings the oil shale to a temperature of from about 500 to 550° C., and thus vaporization of the shale oil from the oil shale actively proceeds. Simultaneously with the above-mentioned reduction of $Mn_2O_3$, $Fe_2O_3$ contained in the manganese pellets 6 is also reduced into $Fe_3O_4$, thus imparting magnetism to the manganese pellets 6.

Also in FIG. 1, 12 is a separator for separating a liquid shale oil from the gas, which contains the gaseous shale oil, hydrogen and carbon monoxide, and is separated by vaporization from the oil shale 1 in the rotary kiln 5; and, 13 is a drum type magnetic separator for separating the manganese pellets 6 from the waste oil shale 1', as discharged through a chute 10 from the rotary kiln 5. The above-mentioned gas separated by vaporization from the oil shale 1 is introduced through a duct 11 from the outlet 5b of the rotary kiln 5 into the separator 12, and cooled in the separator 12. The liquid shale oil is thus separated from the above-mentioned gas and recovered. The waste oil shale 1' after separation of the gas, and the manganese pellets 6 having exchanged heat with the oil shale 1 are both brought to a temperature of about 500° C., discharged from the outlet 5b of the rotary kiln 5, and introduced into the drum type magnetic separator 13 through the chute 10.

The drum type magnetic separator 13 rotates in the arrow direction, and is provided therebelow with a chute 15a for directing the waste oil shale 1' to a combustion installation 16, and also provided with another chute 15b for directing the manganese pellets 6 to a bucket elevator 14. Among the waste oil shale 1' and the manganese pellets 6 introduced through the chute 10 into the drum type magnetic separator 13, the manganese pellets 6, having been imparted magnetism, are magnetically attracted by the drum type magnetic separator 13, move to the position of the chute 15a, are scraped off by a scraper 13a installed near the top end of the chute 15b, and fall into the chute 15b. On the other hand, the waste oil shale 1', having no magnetism, fall into the chute 15a.

In the same figure, 14 is a bucket elevator for transporting the manganese pellets 6, which are separated by the drum type magnetic separator 13, to the heating furnace 7; and 17 is further another chute. The manganese pellets 6 having fallen into the chute 15b are supplied through the bucket elevator 14 and the chute 17 into the heating furnace 7 from the charging port 7a at the top thereof. The manganese pellets 6 supplied to the heating furnace 7 mainly comprise $Mn_3O_4$ as a result of reducing reaction in the rotary kiln 5 as described above, and are reheated and oxidized, in the heating furnace 7, by a fuel and the air blown from a burner 8 provided at the top thereof. As a result, the manganese pellets 6 now mainly comprise $MnO_2$ and $Mn_2O_3$ in the heating furnace 7, and are reheated to a temperature of about 650° C. Then, these manganese pellets 6 are supplied again to the rotary kiln 5 and are thus used in recycle. Contact between the manganese pellets 6 descending through the heating furnace 7 and the air blown from the burner 8 should preferably be effected in the form of parallel flow contact as in this embodiment. In counter flow contact in which the two flows are in directions opposite to each other, local overheating takes place in the manganese pellets 6 in the heating furnace 7 and may cause scaffolding, thus making it impossible for the manganese pellets 6 to descend.

In the drawing, 16 is a travelling grate type combustion installation for burning carbon constituent remaining in an amount of about 6 wt.% in the waste oil shale 1'; 16a is a travelling grate running in the arrow direction; 18 is an ignition furnace provided above the entry of the travelling grate 16a; and, 19 is a wind box installed under the travelling grate 16a. While the waste oil shale 1' supplied onto the entry of the travelling grate 16a from the chute 15a travels on the travelling grate 16a, residual carbon constituent are burnt by a fuel and the air ejected from the ignition furnace 18 and sucked by the wind box 19. The waste oil shale 1' is then cooled by the open air sucked by the wind box 19, and discharged from the travelling grate 16a onto a chute 22. The waste oil shale 1' discharged onto the chute 22 is humidified by a humidifier 20 to prevent diffusion of fine dust, and then rejected.

The high-temperature exhaust gas of about 600° C. produced in the combustion installation 16 is sucked by the wind box 19, introduced into a settling chamber 21 where coarse dust contained in the exhaust gas is removed, and then exchanges heat through a boiler 23, thus permitting recovery of a heat of about 300° C. in the form of steam. Then, the exhaust gas at a temperature of about 300° C. is fed, pressurized by the blower 24, through a duct 25 into the preheater 2 from the hood 2b to preheat the oil shale 1 which travels on the travelling grate 2a prior to the supply of the oil shale 1 into the distilling furnace, i.e., rotary kiln 5. Preheating of the oil shale 1 may also be conducted by supplying a high-temperature exhaust gas produced when heating the manganese pellets 6 in the heating furnace 7, through the duct 25 into the preheater 2. Both the above-mentioned exhaust gas produced by burning carbon contained in the waste oil shale in the combustion installation 16, and the exhaust gas produced in the heat furnace 7 may be fed into the preheater 2.

The exhaust gas after preheating the oil shale 1 is, together with an excess fraction of an exhaust gas which is produced in the combustion installation 16 and then fed through a duct 27, sequentially introduced through a duct 26 into a cyclone 28 and a wet type scrubber 29, and discharged into the open air from the flue 30 after complete removal of dust contained in the exhaust gas.

According to the method of the present invention, as described above in detail, it is possible, when supplying an oil shale, together with a high-temperature granular heat medium, to a distilling furnace, bringing the oil shale into contact with this granular heat medium, and distilling a shale oil from the oil shale through heat exchange with said granular heat medium, to obtain a high-quality shale oil at a high efficiency with a small quantity of heat medium, and also, to easily conduct separation of the waste oil shale and the granular heat medium as discharged from the distilling furnace, irrespective of the particle size thereof, permitting easy use in recycle of the granular heat medium, thus providing industrially useful effects.

What is claimed is:

1. An improved method for distilling shale oil from oil shale comprising:

heating a granular heat medium comprising iron oxides including $Fe_2O_3$ in a heating furnace;

contacting oil shale with said heated granular heat medium in a distillation furnace to heat said oil shale and (i) to vaporize from said oil shale, a gas containing a gaseous shale oil, hydrogen and carbon monoxide, (ii) to reduce, by means of said hydrogen and said carbon monoxide contained in said gas, said $Fe_2O_3$ contained in said granular heat medium into magnetic $Fe_3O_4$ and magnetic metallic iron to impart magnetism to said granular heat medium, and (iii) to form a mixture of (a) said granular heat medium which has been cooled through heat exchange with said shale oil, and (b) waste oil shale;

introducing said gas obtained from said distillation furnace into a separator, where said gas is cooled to separate a liquid shale oil from said gas;

magnetically separating said magnetic granular heat medium from said waste oil shale after separation of said gas; and then feeding back said magnetically separated granular heat medium into said heating furnace to reheat said heat medium and oxidize said magnetic metallic iron and $Fe_3O_4$ and to recycle said heated heat medium to said distillation furnace;

the improvement comprising:

said granular heat medium additionally containing manganese oxides including $Mn_2O_3$ in amounts sufficient to provide supplemental heat during said reduction in said distillation furnace with the heat produced through exothermic reactions of said hydrogen and said carbon monoxide contained in said gas with said $Mn_2O_3$ contained in said granular heat medium.

2. The method of claim 1, wherein said oil shale is preheated before it is contacted with said heated granular heat medium in said distillation furnace.

3. The method of claim 2, wherein said granular heat medium is heated in said heating furnace with a gaseous fuel to produce said heated granular heat medium and a high-temperature exaust gas, and said high-temperature exaust gas is used to preheat said oil shale.

4. The method of claim 2, wherein said waste oil shale which contains carbon is combusted with an oxidizing gas to produce a high temperature exaust gas and said high-temperature exaust gas is used to preheat said oil shale.

5. The method of any one of claims 1, 2, 3 or 4, wherein said granular heat medium comprises a manganese ore which contains iron oxides.

6. The method of any one of claims 1, 2, 3 or 4, wherein said granular heat medium is in the form of pellets comprising manganese oxides and iron oxides.

7. The method of claim 6, wherein said pellets have been formed from manganese ore which has been heated and pelletized.

8. The method of any one of claims 1, 2, 3 or 4, wherein said granular heat medium contains between 3 and 12% by weight of iron oxides.

9. The method of claim 5, wherein said granular heat medium contains between 3 and 12% by weight of iron oxides.

10. The method of claim 6, wherein said granular heat medium contains between 3 and 12% by weight of iron oxides.

11. The method of any one of claims 1, 2, 3 or 4, wherein said oil shale in said distillation furnace is heated to a temperature of between about 400 and 550° C. whereby said gas containing gaseous shale oil, hydrogen and carbon monoxide is vaporized from said oil shale.

12. The method of claim 8, wherein said oil shale in said distillation furnace is heated to a temperature of between about 400 and 550° C. whereby said gas containing gaseous shale oil, hydrogen and carbon monoxide is vaporized from said oil shale.

13. The method of claim 9, wherein said oil shale in said distillation furnace is heated to a temperature of between about 400 and 550° C. whereby said gas containing gaseous shale oil, hydrogen and carbon monoxide is vaporized from said oil shale.

14. The method of claim 10, wherein said oil shale in said distillation furnace is heated to a temperature of between about 400 and 550° C. whereby said gas containing gaseous shale oil, hydrogen and carbon monoxide is vaporized from said oil shale.

* * * * *

UNITED STATES PATENT AND TRADEMARK OFFICE

CERTIFICATE OF CORRECTION

PATENT NO. : 4,427,529

DATED : January 24, 1984

INVENTOR(S) : Hiroaki NISHIO

It is certified that error appears in the above-identified patent and that said Letters Patent is hereby corrected as shown below:

Title Page, left-hand column, in the Title: Before "DISTILLING" insert --METHOD FOR--.

Column 1, line 22: replace "in" with --on--.

Column 2, line 11: before "separator" insert --a--.

Column 5, line 48: the formula to the right of the arrow, replace "$3Mn_3O_4$" with --$2Mn_3O_4$--.

Column 12, lines 1 and 2 (Claim 3): replace "exaust" with --exhaust--.

Column 12, lines 5 and 6 (Claim 4): replace "exaust" with --exhaust--.

Column 12, line 5 (Claim 4): rewrite "high temperature" as --high-tempertaure--.

Signed and Sealed this

*Twenty-sixth* Day of *February 1985*

[SEAL]

*Attest:*

DONALD J. QUIGG

*Attesting Officer* *Acting Commissioner of Patents and Trademarks*